US008532509B2

(12) United States Patent
Yashima et al.

(10) Patent No.: US 8,532,509 B2
(45) Date of Patent: Sep. 10, 2013

(54) IMAGE FORMING APPARATUS AND IMAGE FORMING METHOD

(75) Inventors: Shun Yashima, Ebina (JP); Yoshiki Matsuzaki, Ebina (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 477 days.

(21) Appl. No.: 12/797,344

(22) Filed: Jun. 9, 2010

(65) Prior Publication Data

US 2011/0116818 A1 May 19, 2011

(30) Foreign Application Priority Data

Nov. 13, 2009 (JP) ..... 2009-260330

(51) Int. Cl.
*G03G 15/00* (2006.01)

(52) U.S. Cl.
USPC ..... 399/45; 399/301; 399/49; 399/66; 399/72

(58) Field of Classification Search
USPC ..... 399/45, 301, 49, 66, 72, 394
See application file for complete search history.

(56) References Cited

U.S. PATENT DOCUMENTS

| | | | | |
|---|---|---|---|---|
| 2005/0074248 | A1* | 4/2005 | Akita et al. | 399/45 |
| 2005/0275896 | A1* | 12/2005 | Taguma | 358/1.18 |
| 2007/0126851 | A1* | 6/2007 | Yamazaki | 347/233 |

FOREIGN PATENT DOCUMENTS

| | | | |
|---|---|---|---|
| JP | 1-142679 | A | 6/1989 |
| JP | 11-065315 | A | 3/1999 |
| JP | 2001-092202 | A | 4/2001 |
| JP | 2003-307901 | A | 10/2003 |
| JP | 2006-091904 | A | 4/2006 |
| JP | 2006-267400 | A | 10/2006 |
| JP | P2577407 | A | 6/2010 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An image forming apparatus includes a plurality of toner-image forming units that receive image data and form electrostatic latent images on image bearing members in accordance with the image data, and form toner images of respective colors by developing the electrostatic latent images, an intermediate transfer member onto which the toner images are transferred, a transfer unit that transfers the toner images of the respective colors onto the intermediate transfer member, a controller that performs transfer control for changing a transfer pressure applied when the transfer unit transfers the toner images onto the intermediate transfer member, and a misregistration detector that detects a difference of a transfer position of each of the toner images of the respective colors on the intermediate transfer member when the transfer control is performed by the controller.

10 Claims, 12 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2009-260330 filed Nov. 13, 2009.

BACKGROUND (i) Technical Field

The present invention relates to an image forming apparatus and an image forming method.

(ii) Related Art

It is known that, in image forming apparatuses that form a color image by forming images of multiple colors with respective toners and superimposing the images of respective colors with each other, a color misregistration of an image transferred onto a recording sheet is caused by relative misregistrations between the images of respective colors.

SUMMARY

According to an aspect of the invention, there is provided an image forming apparatus including a plurality of toner-image forming units that receive image data and form electrostatic latent images on image bearing members in accordance with the image data, and form toner images of respective colors by developing the electrostatic latent images; an intermediate transfer member onto which the toner images are transferred; a transfer unit that transfers the toner images of the respective colors onto the intermediate transfer member; a controller that performs transfer control for changing a transfer pressure applied when the transfer unit transfers the toner images onto the intermediate transfer member; and a misregistration detector that detects a difference of a transfer position of each of the toner images of the respective colors on the intermediate transfer member when the transfer control is performed by the controller.

BRIEF DESCRIPTION OF THE DRAWINGS

An exemplary embodiment of the present invention will be described in detail based on the following figures, wherein.

DETAILED DESCRIPTION

Structure

Figure 1:
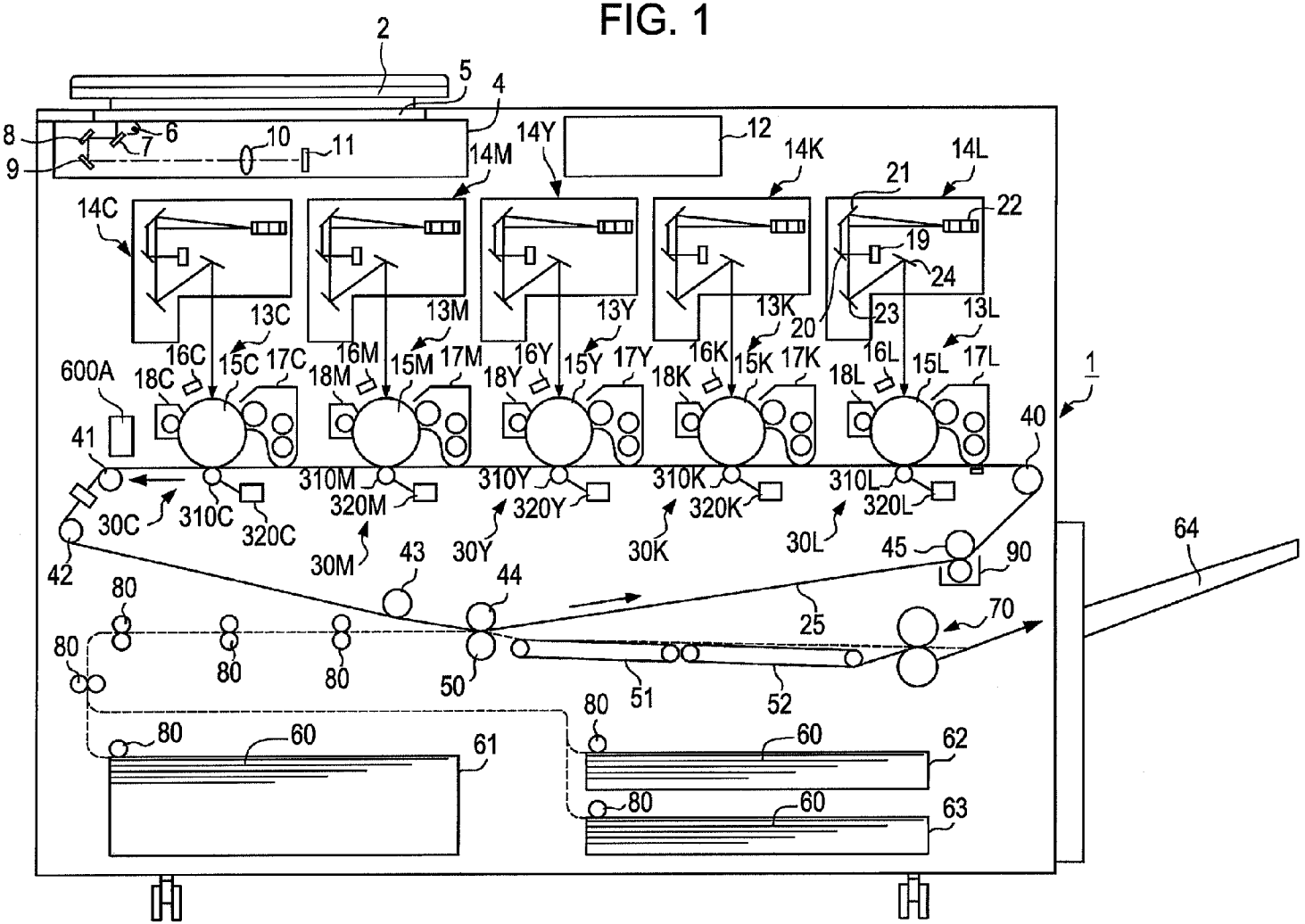
FIG. 1 is a schematic diagram illustrating the structure of an image forming apparatus according to an exemplary embodiment.

FIG. 1 is a schematic diagram illustrating the structure of an image forming apparatus 1 according to an exemplary embodiment of the present invention. A cover that presses an original document 2 against a platen glass 5 and an image reading device 4 that reads an image on the original document 2 placed on the platen glass 5 are provided in an upper section of the image forming apparatus 1. The image reading device 4 emits light toward the original document 2 placed on the platen glass 5 from a light source 6. The light is reflected by the original document 2 and is then reflected by a full-rate mirror 7 and half-rate mirrors 8 and 9. Then, the light is guided through a lens 10 to an image reading element 11 including charge coupled devices (CCD). The image reading element 11 converts the image on the original document 2 into red (R), green (G), and blue (B) electrical signals and output the electrical signals to an image processing device 12. In the present exemplary embodiment, a copying function in which the original document 2 is read by the image reading device 4 is mainly described. However, the image forming apparatus 1 also has a function as a printer in which image data of an image to be printed is received from an apparatus, such as a personal computer (PC), disposed outside the image forming apparatus 1 and is output to the image processing device 12.

The image processing device 12 subjects the image represented by the electrical signals output from the image reading device 4 to image processes, such as shading correction, misregistration correction, brightness/color-space conversion, gamma correction, frame erasing, color and movement editing, and color misregistration correction. The image processing device 12 converts the image that has been subjected to the image processes into image data (raster data) of five colors, which are yellow (Y), magenta (M), cyan (C), black (K), and clear (L). The image data of respective colors is transmitted to exposure devices 14K, 14Y, 14M, 14C, and 14L included in image forming units 13K, 13Y, 13M, 13C, and 13L for the respective colors.

In the drawings and the following description, the letter 'Y' is attached to reference numerals that denote components used to form a yellow image. Similarly, the letters 'M', 'C', 'K', and 'L' are attached to reference numerals that denote components used to form a magenta image, a cyan image, a black image, and a clear image, respectively.

The image forming units 13K, 13Y, 13M, 13C, and 13L are units that respectively form yellow, magenta, cyan, black, and clear toner images. The image forming apparatus 1 is provided with attachment sections to which the image forming units 13K, 13Y, 13M, 13C, and 13L can be attached. The image forming units 13K, 13Y, 13M, 13C, and 13L can be attached to and detached from the image forming apparatus 1, and are arranged parallel to each other with constant intervals therebetween along a horizontal direction in the image forming apparatus 1. In the present exemplary embodiment, the five image forming units 13K, 13Y, 13M, 13C, and 13L have a similar structure. Therefore, the letters 'Y', 'M', 'C', 'K', and 'L' will be omitted when the structure of each image forming unit is described.

Each image forming unit 13 includes a photosensitive drum 15, a scorotron 16, an exposure device 14, a developing unit 17, and a cleaning device 18. The photosensitive drum 15 is an example of an image bearing member, and rotates at a constant rotation speed in a direction indicated by the arrow. The scorotron 16 is used in a first charging process for uniformly charging the surface of the photosensitive drum 15. The exposure device 14 emits light corresponding to an image of each color toward the surface of the photosensitive drum 15 to form an electrostatic latent image. The developing unit 17 develops the electrostatic latent image formed on the photosensitive drum 15 with toner. The cleaning device 18 removes the toner from the photosensitive drum 15.

The exposure device 14 corresponding to each color emits a laser beam from a laser device 19 in accordance with image data transmitted from the image processing device 12. The laser beam emitted from the laser device 19 is guided by reflective mirrors 20 and 21 to a rotating polygon mirror 22 having a polygonal shape, which has plural reflective side surfaces, and is reflected by the polygon mirror 22. The laser beam reflected by the rotating polygon mirror 22 is reflected again by the reflective mirror 21, and is reflected by plural reflective mirrors 23 and 24 so as to scan the photosensitive drum 15, which is an image bearing member. As a result, an electrostatic latent image is formed on the surface of the photosensitive drum 15. Thus, electrostatic latent images are formed on respective photosensitive drums 15K, 15Y, 15M, 15C, and 15L, and are developed by developing units 17K, 17Y, 17M, 17C, and 17L as black, yellow, magenta, cyan, and clear toner images.

The toner images of the respective colors formed on the photosensitive drums 15K, 15Y, 15M, 15C, and 15L are transferred in a superimposed manner onto an intermediate transfer belt 25, which serves as an intermediate transfer member, by first transfer devices 30K, 30Y, 30M, 30C, and 30L, which have a similar structure. The intermediate transfer belt 25 is positioned under the image forming units 13K, 13Y, 13M, 13C, and 13L. The process of transferring the toner images onto the intermediate transfer belt 25 is hereinafter referred to as a first transfer process.

In the present exemplary embodiment, toner images that have been transferred onto the intermediate transfer belt 25 by the first transfer devices 30K, 30Y, 30M, 30C, and 30L, which will be described below, in the first transfer process are transferred onto a recording medium (hereinafter referred to as a recording sheet). A transfer pressure applied in the first transfer process is changed in accordance with whether the type (hereinafter referred to as the paper type) of the recording sheet is normal paper or embossed paper. In the present exemplary embodiment, the normal paper and the embossed paper are explained as examples of the types of recording sheets. However, overhead projector (OHP) sheet, for example, may also be used as a recording medium. The first transfer devices 30K, 30Y, 30M, 30C, and 30L have a similar structure. Therefore, the letters 'Y', 'M', 'C', 'K', and 'L' will be omitted when the structure of each first transfer device is described.

The intermediate transfer belt 25 is stretched around rollers 40 to 45 with a certain tension applied thereto, and is rotated at a certain speed in the direction indicated by the arrow by the roller 40, which is rotated by a motor (not shown). In the present exemplary embodiment, the intermediate transfer belt 25 is formed in the shape of an endless belt by, for example, forming a band-shaped flexible synthetic-resin film made of polyimide or the like and connecting ends of the band-shaped flexible synthetic-resin film to each other by welding or the like.

The toner images of the respective colors that have been transferred onto the intermediate transfer belt 25 in a superimposed manner are transferred by a second transfer roller 50, which is pressed against the roller 44, onto a recording sheet 60 that has been conveyed to the second transfer roller 50. The process of transferring the toner images onto the recording sheet 60 is hereinafter referred to as a second transfer process. While the recording sheet 60 is being conveyed between the second transfer roller 50 and the roller 44 that is disposed inside the intermediate transfer belt 25, a second transfer bias is applied to the second transfer roller 50. The second transfer bias has a polarity opposite to the polarity of the toner that has been transferred onto the intermediate transfer belt 25 in the first transfer process. Therefore, an electrostatic force is applied to the toner on the intermediate transfer belt 25 in the direction from the intermediate transfer belt 25 to the recording sheet 60, so that the toner is transferred onto the surface of the recording sheet 60 in the second transfer process.

The recording sheet 60 onto which the toner images of the respective colors have been transferred in the second transfer process is conveyed to a fixing unit 70 by two conveying rollers 51 and 52. The recording sheet 60 onto which the toner images have been transferred is subjected to a fixing process in which heat and pressure are applied by the fixing unit 70, and is then ejected to a paper ejection tray 64.

The recording sheet 60 is fed from one of storage units 61 to 63 for storing recording sheets 60, and is conveyed to the intermediate transfer belt 25 along sheet-conveying paths (shown by broken lines) including rollers 80. After the toner image on each photosensitive drum 15 is transferred onto the intermediate transfer belt 25, residual toner, paper dust, etc., are removed from the photosensitive drum 15 by the cleaning device 18 to be ready for the next image forming process. Residual toner on the intermediate transfer belt 25 is removed by a belt cleaner 90.

Structure of First Transfer Device 30

The structure of each first transfer device 30 will now be described. The first transfer device 30 is disposed inside the intermediate transfer belt 25 at a position where the first transfer device 30 is opposed to the corresponding photosensitive drum 15. The first transfer device 30 includes a first transfer roller 310 disposed at a position where the first transfer roller 310 is opposed to the photosensitive drum 15 and a first transfer bias source 320 that applies a first transfer bias to the first transfer roller 310. The first transfer roller 310 presses the intermediate transfer belt 25 against the photosensitive drum 15, and the first transfer bias source 320 changes the first transfer bias applied to the first transfer roller 310.

Figure 2B:
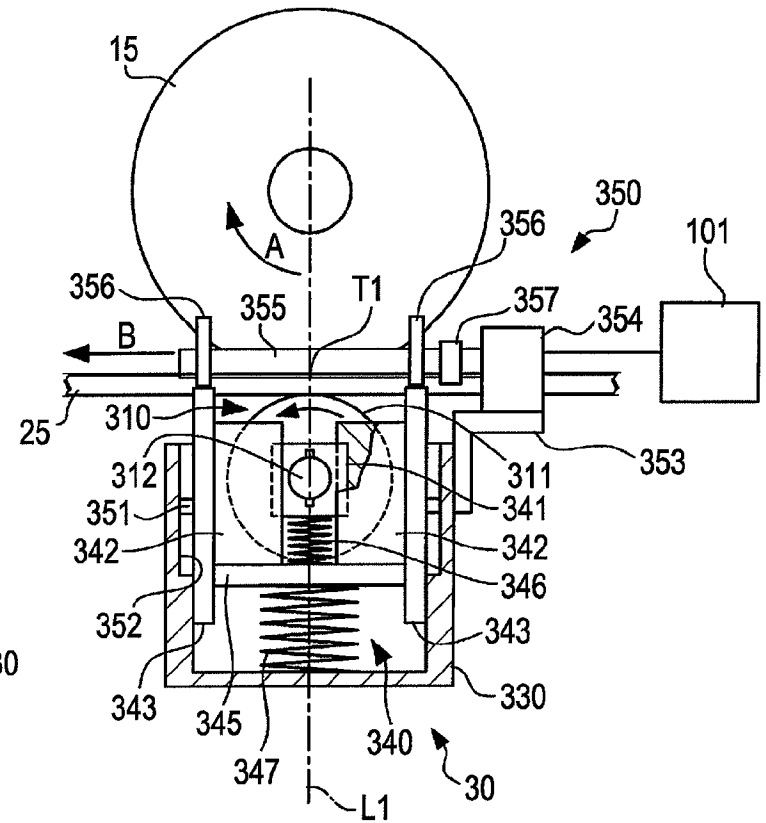
FIG. 2B is a partially sectioned side view illustrating the first transfer device according to the exemplary embodiment in the normal-paper receiving state.
Figure 2A:
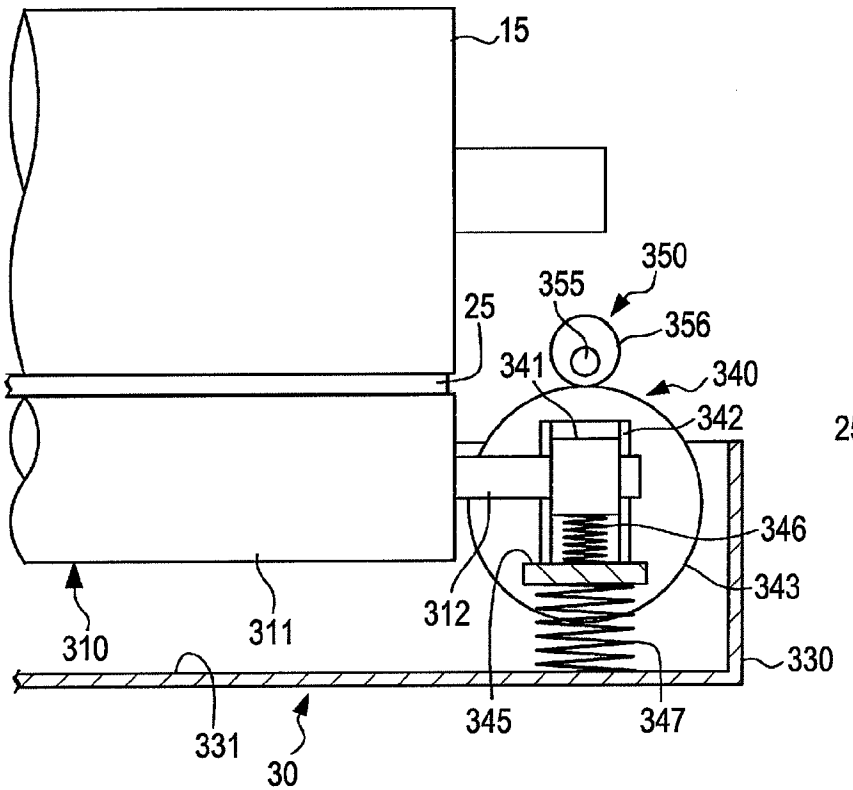
FIG. 2A is a partially sectioned front view illustrating a first transfer device according to the exemplary embodiment in a normal-paper receiving state.

As illustrated in FIG. 2A, the first transfer roller 310 includes a roller body 311 and shaft members 312 that extend in an axial direction and project from the roller body 311 at either end thereof. The first transfer roller 310 is disposed in a rectangular housing 330 that is opposed to the photosensitive drum 15 with the intermediate transfer belt 25 disposed therebetween. The housing 330 has an open face at the top, and the first transfer roller 310 can be moved in a vertical direction through the open face.

An urging mechanism 340 is provided on an inner bottom surface 331 of the housing 330 at a position corresponding to each of the shaft members 312 of the first transfer roller 310. Each urging mechanism 340 urges the first transfer roller 310 upward, that is, toward the photosensitive drum 15 to press the intermediate transfer belt 25 against the photosensitive drum 15. The position at which the first transfer roller 310 and the photosensitive drum 15 are in contact with the intermediate transfer belt 25 corresponds to a first transfer position T1 (see FIG. 2B) at which the first transfer process is performed. The urging force that presses the intermediate transfer belt 25 against the photosensitive drum 15 is adjusted on the basis of a control signal corresponding to the type of the recording sheet, that is, one of the normal paper and the embossed paper.

Each urging mechanism 340 includes a bearing 341 that supports the corresponding shaft member 312 of the first transfer roller 310 in a rotatable manner; a pair of guide rails 342 that guide the movement of the bearing 341 in the vertical direction; a pair of discs 343 attached to the respective guide rails 342; a base 345 that connects the discs 343 to each other; a first coil spring 346 provided between the base 345 and the bearing 341 to urge the bearing 341 upward; a second coil spring 347 disposed between the base 345 and the bottom surface 331 to urge the base 345 upward; and a moving mechanism 350 that moves the discs 343 in the vertical direction.

The bearing 341 has, for example, a rectangular parallelepiped shape and is slidably clamped between the guide rails 342 having an angular U shape at opposite sides thereof. More specifically, the opposite side portions of the bearing 341 are fitted into recesses provided in the angular-U-shaped guide rails 342. A retaining pin for preventing a displacement of the first transfer roller 310 in the axial direction is inserted into an end portion of the shaft member 312.

The guide rails 342 extend in the vertical direction, and back surfaces of the guide rails 342 are attached to the respective discs 343. Bottom end portions of the guide rails 342 are in contact with the top surface of the base 345, which has a plate shape. The base 345 is disposed such that the top surface thereof is parallel to the intermediate transfer belt 25. The first coil spring 346 is attached to the bottom surface of the bearing 341 at one end thereof, and to the top surface of the base 345 at the other end thereof. The first coil spring 346 is disposed such that, when viewed in a direction of FIG. 2B (in a side view), the central axis of the first coil spring 346 coincides with a straight line L1 that extends in a radial direction of the photosensitive drum 15 (straight line that passes through the center of the photosensitive drum 15 and the center of the first transfer roller 310 in this example).

The second coil spring 347 is attached to the bottom surface of the base 345 at one end thereof and to the bottom surface 331 at the other end thereof. Similar to the first coil spring 346, the second coil spring 347 is also disposed such that, when viewed in a direction of FIG. 2B (in a side view), the central axis of the second coil spring 347 coincides with the straight line L1 that extends in the radial direction of the photosensitive drum 15.

As illustrated in FIG. 2B, the moving mechanism 350 includes columnar projections 351, guide grooves 352, a stepping motor 354, an extension shaft 355, and a pair of cams 356. The projections 351 are provided on outer surfaces of the respective discs 343. The guide grooves 352 are formed in inner wall surfaces of the housing 330 at positions corresponding to the projections 351, and guide the movement of the projections 351 fitted in the guide grooves 352 in the vertical direction. The stepping motor 354 is placed on, for example, the top surface of an inverted L-shaped base 353 having a portion fixed to an outer wall surface of the housing 330. The extension shaft 355 extends from a rotating shaft of the stepping motor 354. The cams 356 are provided on the extension shaft 355 and move the discs 343 in the vertical direction. The extension shaft 355 is connected to the rotating shaft of the stepping motor 354 with a coupling 357 provided therebetween. The stepping motor 354 is attached to the top surface of the base 353 such that the extension shaft 355 extends parallel to the axial direction of the discs 343 at a position above the discs 343. The cams 356 are arranged such that the outer peripheral surfaces thereof are in contact with the outer peripheral surfaces of the respective discs 343.

Each first transfer device 30 having the above-described structure changes the transfer pressure at which the intermediate transfer belt 25 is pressed against the photosensitive drum 15 in accordance with the control signal transmitted from a control unit 101, which will be described below. More specifically, the transfer pressure for when the paper type of the recording sheet on which image data is to be recorded is the embossed paper, which has a larger degree of surface irregularity than that of the normal paper, is set to be lower than the transfer pressure for when the paper type is the normal paper.

Figure 3B:
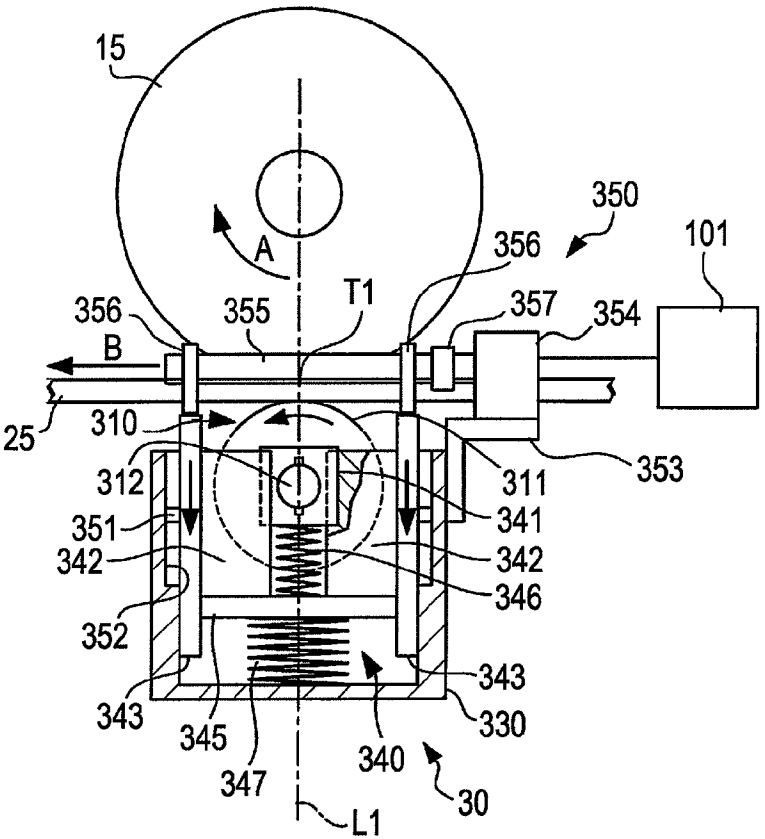
FIG. 3B is a partially sectioned side view illustrating the first transfer device according to the exemplary embodiment in the embossed-paper receiving state.
Figure 3A:
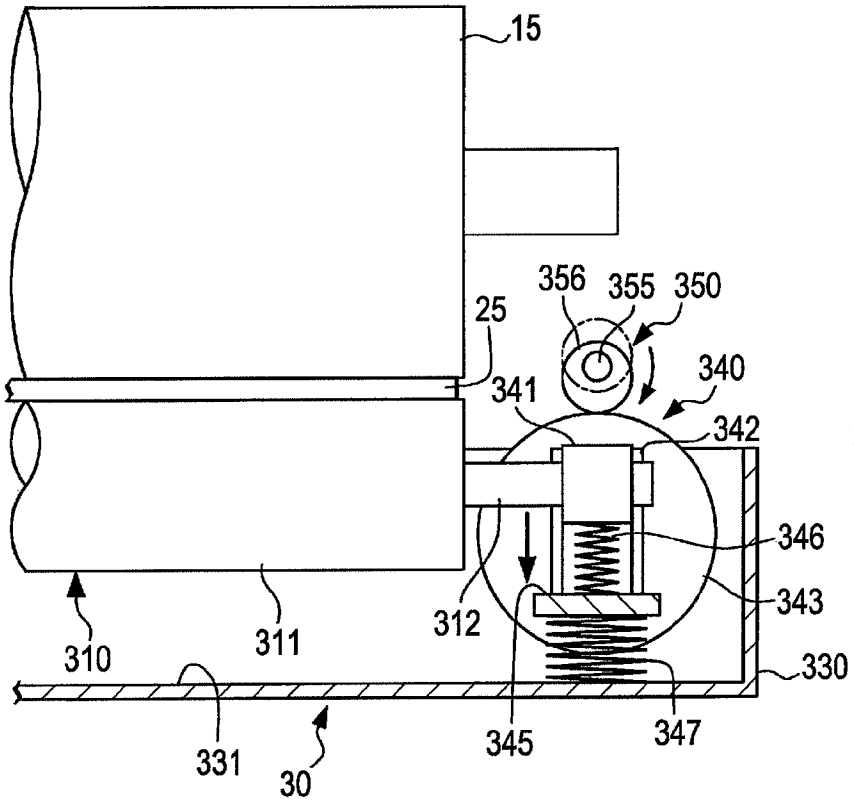
FIG. 3A is a partially sectioned front view illustrating the first transfer device according to the exemplary embodiment in an embossed-paper receiving state.

In the present exemplary embodiment, the state illustrated in FIGS. 2A and 2B is the state of each first transfer device 30 for transferring an image onto a sheet of normal paper (hereinafter referred to as a normal-paper receiving state). The state illustrated in FIGS. 3A and 3B is the state of each first transfer device 30 for transferring an image on a sheet of embossed paper (hereinafter referred to as an embossed-paper receiving state). The operation of the first transfer device 30 for changing the state thereof from the normal-paper receiving state illustrated in FIGS. 2A and 2B to the embossed-paper receiving state illustrated in FIGS. 3A and 3B will now be described.

In the first transfer device 30, the stepping motor 354 receives an embossed-paper control signal representing that the state of the first transfer device 30 is to be switched to the embossed-paper receiving state from the control unit 101. Then, the stepping motor 354 starts to rotate. Accordingly, the cams 356 rotate and the discs 343 are pushed downward by protruding portions of the cams 356 (portions at which the distance from the extension shaft 355 is relatively large). When the discs 343 are pushed downward, the second coil spring 347, which moves together with the discs 343, is compressed.

The first coil spring 346 continuously urges the first transfer roller 310 upward even when the base 345 is moved downward. However, the transfer pressure at which the intermediate transfer belt 25 is pressed against the photosensitive drum 15 is reduced from that in the normal-paper receiving state. Accordingly, in the embossed-paper receiving state, the force with which the intermediate transfer belt 25 is pressed against the photosensitive drum 15 is lower than that in the normal-paper receiving state. Therefore, the adhesion force applied to the toner images transferred onto the intermediate transfer belt 25 is also reduced. Since the transfer pressure applied in the first transfer process is reduced for the embossed paper, the electrostatic force applied to the toner that has adhered to the intermediate transfer belt 25 is smaller than that in the case of the normal paper.

The embossed paper has recessed and projecting portions, and the distance from the recessed portions to the intermediate transfer belt 25 is larger than that from the projecting portions to the intermediate transfer belt 25 in the second transfer process in which the toner images on the intermediate transfer belt 25 are transferred onto the recording sheet 60. Therefore, a transfer electric field applied to the recessed portions by the second transfer roller 50 in the second transfer process is weaker than that applied to the projecting portions. Accordingly, the electrostatic force that attracts the toner that has adhered to the intermediate transfer belt 25 to the recessed portions is relatively weak. However, as described above, in the case of transferring an image on a sheet of embossed paper, the transfer pressure applied by the first transfer device 30 in the first transfer process is reduced from that applied in the case of transferring an image on a sheet of normal paper. Therefore, the adhesion force applied to the toner images on the intermediate transfer belt 25 is also reduced. As a result, at the position where the second transfer process is performed, the toner that has adhered to the intermediate transfer belt 25 is easily attracted to the recessed portions of the embossed paper when the transfer electric field is applied thereto in the second transfer process. Therefore, the toner images can be reliably transferred to the embossed paper in both the recessed and projecting portions, and the risk that the toner cannot adhere to recessed portions and the corresponding portions of the image will be blank can be reduced.

In the case where the paper type of the recording sheet 60 is switched from the embossed paper to the normal paper, the first transfer device 30 rotates the stepping motor 354 in a normal or reverse direction so that the state of the first transfer device 30 switches from the embossed-paper receiving state illustrated in FIGS. 3A and 3B to the normal-paper receiving state illustrated in FIGS. 2A and 2B.

In the present exemplary embodiment, the transfer pressure applied by the first transfer device 30 in the first transfer process is changed in accordance with the paper type of the recording sheet 60. If the transfer pressure is changed while the intermediate transfer belt 25 is in contact with the photosensitive drum 15 without separating the intermediate transfer belt 25 and the photosensitive drum 15 from each other, the tension applied to the intermediate transfer belt 25 varies. As a result, the transfer position at which the toner image formed by the corresponding image forming unit 13 is transferred will be displaced.

Therefore, according to the present exemplary embodiment, if the paper type of the recording sheet 60 is switched from the normal paper to the embossed paper or from the embossed paper to the normal paper, the following processes are performed before an image specified by the user (hereinafter referred to as a specified image), which is to be transferred onto the recording sheet 60, is formed in the image forming unit 13. That is, a transfer control process is performed to change the transfer pressure applied by the first transfer device 30. In addition, a misregistration detection process is performed to detect the difference of the transfer position and a correction process is performed to correct the image forming position of the specified image in accordance with the result of the detection. The structure for performing the above-described processes in the image forming apparatus 1 will now be described.

Figure 4:
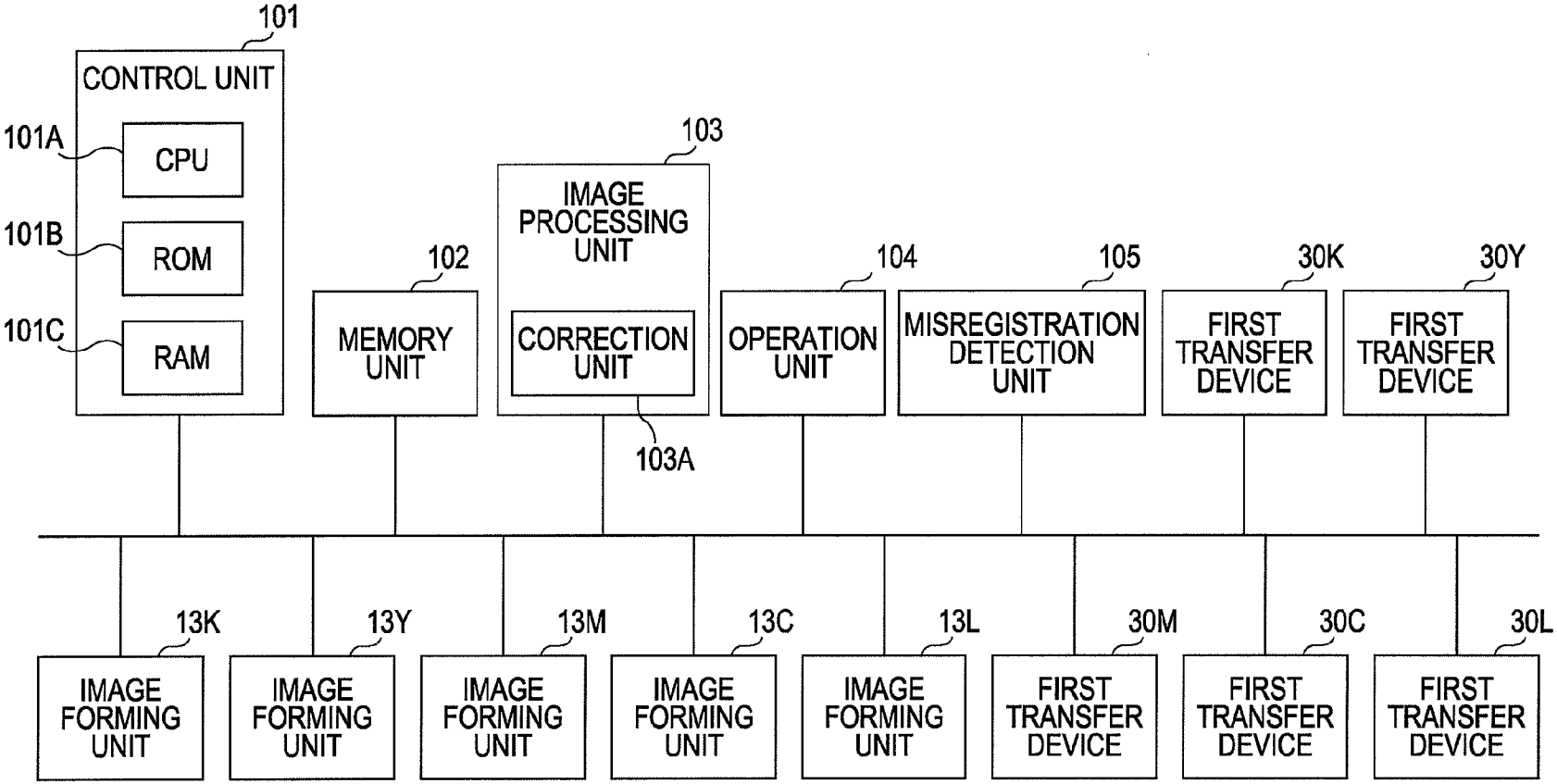
FIG. 4 is a block diagram illustrating the structure of the image forming apparatus according to the exemplary embodiment.

The image forming apparatus 1 includes a structure for performing the above-described transfer control process for controlling the transfer pressure applied by each first transfer device 30, the misregistration detection process, and the correction process in addition to the structure for performing a usual image forming process. The structures of the image forming apparatus 1 will now be described. FIG. 4 is a block diagram illustrating the structure for performing the transfer control process, the misregistration detection process, and the correction process in the image forming apparatus 1. As illustrated in FIG. 4, the image forming apparatus 1 includes the control unit 101, a memory unit 102, an image processing unit 103, an operation unit 104, a misregistration detection unit 105, the image forming units 13K, 13Y, 13M, 13C, and 13L, and the above-described first transfer devices 30K, 30Y, 30M, 30C, and 30L, which are connected to each other by lines.

The control unit 101 includes a central processing unit (CPU) 101A, a read only memory (ROM) 101B, and a random access memory (RAM) 101C. The ROM 101B stores control programs, and the CPU 101A executes the control programs using the RAM 101C as a working area, thereby controlling each part of the image forming apparatus 1 to activate the image forming apparatus 1. More specifically, the control unit 101 outputs a control signal for carrying out the transfer control process in which the transfer pressure applied by each first transfer device 30 is changed in accordance with the paper type of the recording sheet 60. In addition, the control unit 101 performs the misregistration detection process for detecting the difference of the transfer position. In an example of the misregistration detection process according to the present exemplary embodiment, each image forming unit 13 receives image data of a test pattern and transfers an image of the test pattern onto the intermediate transfer belt 25, and the misregistration of the image is detected. In addition, in the present exemplary embodiment, first-transfer-control information representing the control state (the normal-paper receiving state or the embossed-paper receiving state) of each first transfer device 30 set when the toner images have been transferred onto the recording sheet 60 the last time is stored in the memory unit 102, which will be described below. Then, when the toner images are transferred onto the next recording sheet 60, the transfer control process for changing the control state of each first transfer device 30 is performed on the basis of the first transfer control information and the paper type.

The memory unit 102 is formed of a nonvolatile storage medium, and stores image data of the test pattern (hereinafter referred to as pattern image data) and data of various setting information, such as the first transfer control information, set in the image forming apparatus 1. The operation unit 104 includes, for example, a touch-panel display device for displaying messages and a menu screen through which the paper type of the recording sheet 60, for example, can be specified, and receives instructions from the user.

Figure 5:
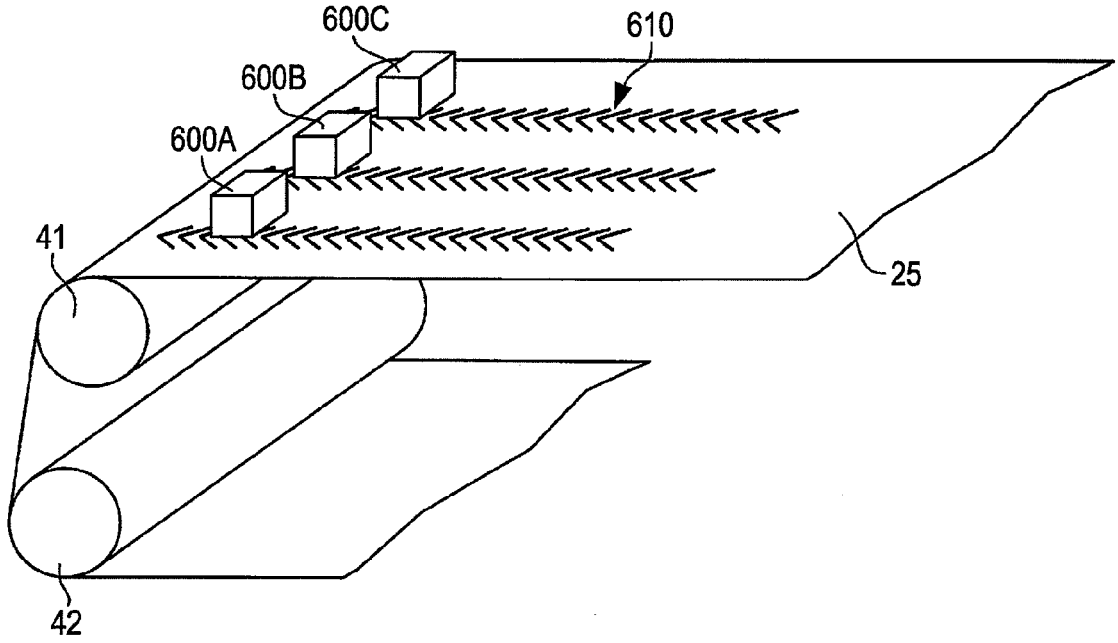
FIG. 5 is a diagram illustrating a detection process for detecting a test pattern according to the exemplary embodiment.

The misregistration detection unit 105 detects the test pattern that has been transferred onto the intermediate transfer belt 25 for detecting the difference of the transfer position on the intermediate transfer belt 25. The misregistration detection unit 105 includes pattern detectors 600A, 600B, and 600C (hereinafter referred to as pattern detectors 600 unless they are distinguished from each other). The misregistration detection process according to the present exemplary embodiment will now be described. FIG. 5 is a conceptual diagram illustrating the detection of the image of the test pattern transferred onto the intermediate transfer belt 25 with the pattern detectors 600.

According to the present exemplary embodiment, as illustrated in FIG. 5, a test pattern 610, which is a so-called chevron pattern, for detecting the image position is formed on the intermediate transfer belt 25 and is detected by each of the pattern detectors 600. The pattern detectors 600 are disposed downstream of the image forming unit 13C in the moving direction of the intermediate transfer belt 25, and are positioned at respective predetermined measurement reference positions in an OUT section (front section in FIG. 5), a CENTER section (central section in FIG. 5), and an IN section (rear section in FIG. 5) of the image forming apparatus 1 along a main scanning direction. However, four or more pattern detectors 600 may instead be formed with constant intervals therebetween along the width direction of the intermediate transfer belt 25 as necessary.

Patterns of various shapes can be used as the test pattern 610. In the present exemplary embodiment, the test pattern 610 includes angle-shaped marks formed at positions corresponding to the pattern detectors 600A, 600B, and 600C, each angle-shaped mark including straight lines that are connected to each other at the center and inclined leftward and rightward at the same angle. In the test pattern 610 according to the present exemplary embodiment, one of the six colors is set as a reference color, and the angle-shaped marks of respective colors are formed such that the angle-shaped marks are arranged along a sub-scanning direction (moving direction of the intermediate transfer belt 25) with predetermined intervals therebetween.

Figure 6A:
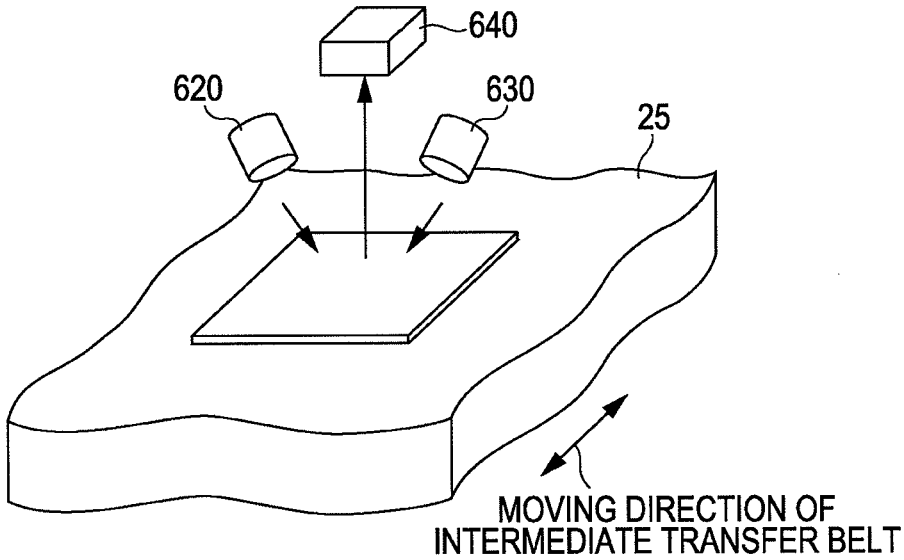
FIG. 6A is a diagram illustrating the structure of pattern detectors according to the exemplary embodiment.
Figure 6B:
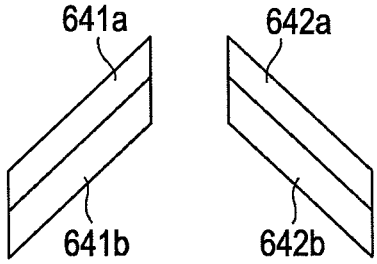
FIG. 6B is a diagram illustrating the structure of a light receiving unit according to the exemplary embodiment.

The structure of each pattern detector 600 for detecting the test pattern 610 will now be described. FIGS. 6A and 6B are schematic diagrams illustrating the structure of each pattern detector 600. As illustrated in FIG. 6A, each pattern detector 600 includes light emitting diodes (LED) 620 and 630 which are inclined at predetermined angles and emit light toward the intermediate transfer belt 25 and a light receiving unit 640.

Plural photodiodes, which are light receiving elements, are combined in the light receiving unit 640. As illustrated in FIG. 6B, the light receiving unit 640 includes first light receiving elements 641*a* and 641*b* (hereinafter referred to as first light receiving elements 641 unless they are distinguished from each other) and second light receiving elements 642*a* and 642*b* (hereinafter referred to as second light receiving elements 642 unless they are distinguished from each other). The first light receiving elements 641 and the second light receiving elements 642 are inclined at a predetermined angle with respect to the horizontal direction of the intermediate transfer belt 25, and are arranged symmetrically to each other in the left-right direction.

The first and second light receiving elements 641 and 642 receive light emitted by the LEDs 620 and 630 and reflected by the test pattern 610 formed on the intermediate transfer belt 25, and output signals corresponding to the amounts of the reflected light. In the case where there is no misregistration in the main-scanning direction, the first light receiving element 641*a* and the second light receiving element 642*a* output signals corresponding to the amounts of the reflected light at the same time. Then, after a certain time period from when the signals are output from the first and second light receiving elements 641*a* and 642*a*, the first and second light receiving elements 641*b* and 642*b* output signals corresponding to the amounts of the reflected light.

The misregistration detection unit 105 compares the signals output from the first and second light receiving elements 641 and 642 with a predetermined threshold. The misregistration detection unit 105 outputs a low-level signal while the waveform of each signal is lower than the threshold and outputs a high-level signal while the waveform of each signal is higher than or equal to the threshold.

The image processing unit 103 is included in the image processing device 12, and subjects the data of the specified image to image processes, such as density adjustment. The image processing unit 103 includes a correction unit 103A. The correction unit 103A receives waveform of each detection signal for the reference color from the misregistration detection unit 105, and detects a time interval from when the detection signal has changed from the low level to the high level the first time to when the detection signal has changed from the low level to the high level the second time. The correction unit 103A determines the misregistration values of the reference color in the main-scanning and sub-scanning directions on the basis of the detected time intervals, and then determines the misregistration values of the other colors with respect to the misregistration values of the reference color on the bass of the intervals between the images included in the test pattern 610 set in advance. Then, the correction unit 103A determines correction values for correcting the image forming positions for the image data on the basis of the determined misregistration values. In the present exemplary embodiment, an example in which the image data is corrected on the basis of the determined correction values will be described. However, the image forming positions may instead be corrected by other known methods, such as a method of adjusting the exposure timing, for correcting a color misregistration of an image.

Figure 7:
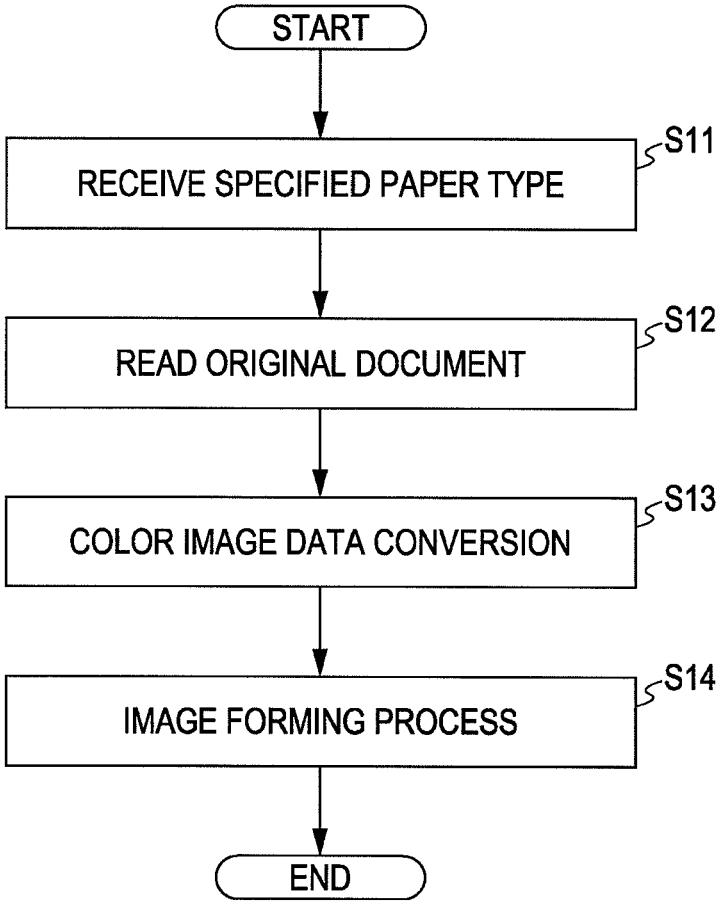
FIG. 7 illustrates an operation flow of the overall operation performed by the image forming apparatus according to the exemplary embodiment.

The operation of the image forming apparatus 1 according to the present exemplary embodiment will now be described. FIG. 7 illustrates the operation flow of the overall operation performed by the image forming apparatus 1. First, the control unit 101 of the image forming apparatus 1 receives a command for specifying the paper type of the recording sheet 60 through the operation unit 104 (step S11).

Then, the image reading device 4 reads an original document specified by the user (step S12). The control unit 101 converts the image data of the specified image read by the image processing device 12 in step S12 into color image data for the five colors, and stores the image data of the respective colors in a storage area of the RAM 101C (step S13). Then, the control unit 101 performs an image forming process in which the image data of the respective colors corresponding to the specified image, which has been stored in the RAM 101C in step S13, is transferred onto the recording sheet 60 of the paper type specified in step S11 (step S14).

Figure 8:
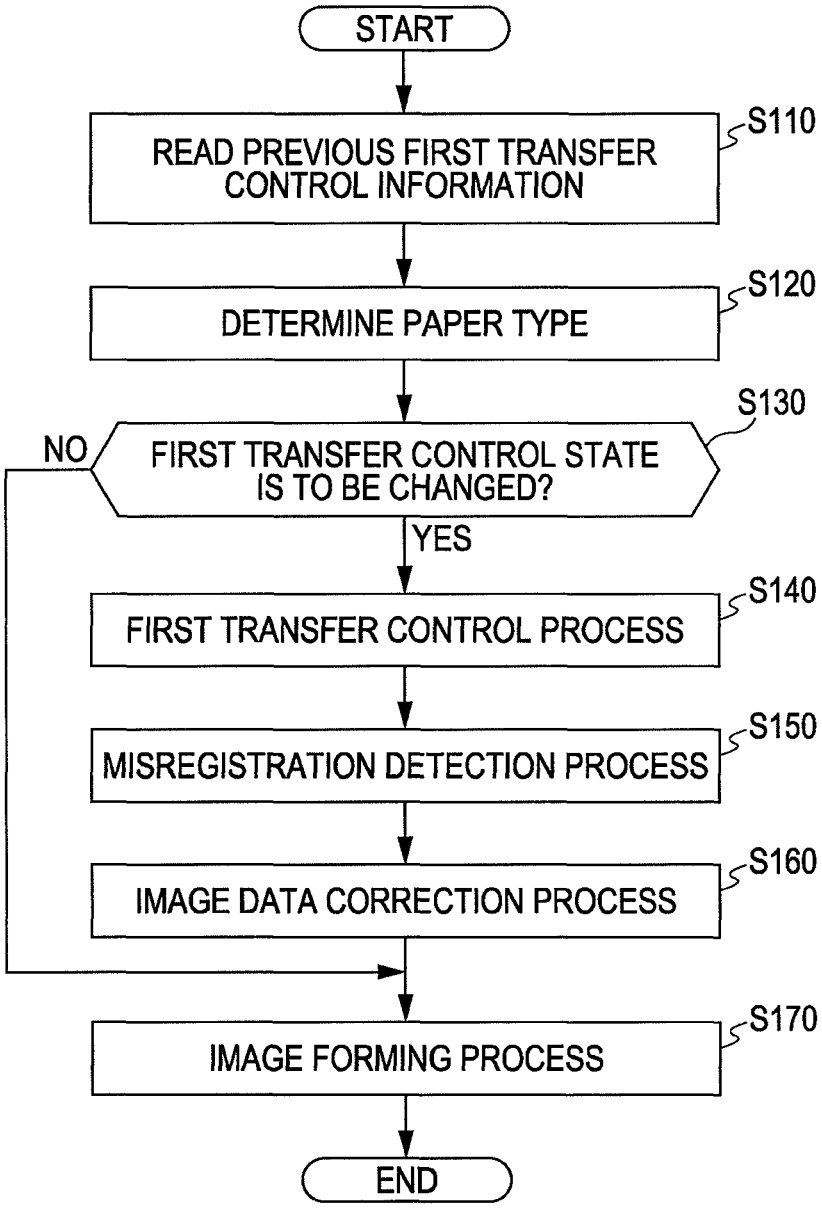
FIG. 8 illustrates an operation flow of an image forming process performed by the image forming apparatus according to the exemplary embodiment.

FIG. 8 illustrates the operation flow of the image forming process. The control unit 101 reads the first transfer control information stored in the memory unit 102 (step S110). Then, the control unit 101 determines whether the paper type specified by the user in step S11 is the normal paper or the embossed paper (step S120).

Then, the control unit 101 determines whether or not the control state of each first transfer device 30 is to be changed in accordance with whether or not the previous control state of the first transfer device 30 based on the first transfer control information read in step S110 is the same as the control state corresponding to the paper type determined in step S120 (step S130). More specifically, if the paper type of the recording sheet 60 that has been previously subjected to the transfer process is the normal paper, the first transfer device 30 is currently set to the normal-paper receiving state. Therefore, if the paper type of the recording sheet 60 to be subjected to the transfer process next is the embossed paper, it is determined that the control state of the first transfer device 30 is to be changed since the first transfer device 30 is not currently set to the control state corresponding to the embossed paper. If the recording sheet 60 to be subjected to the transfer process next is the normal paper, it is determined that it is not necessary to change the control state of the first transfer device 30 since the first transfer device 30 is currently set to the control state corresponding to the normal paper. Similarly, also in the case where the paper type of the recording sheet 60 that has been previously subjected to the transfer process is the embossed paper, the control state of the first transfer device 30 is changed depending on the paper type of the recording sheet 60 to be subjected to the transfer process next.

Figure 9:
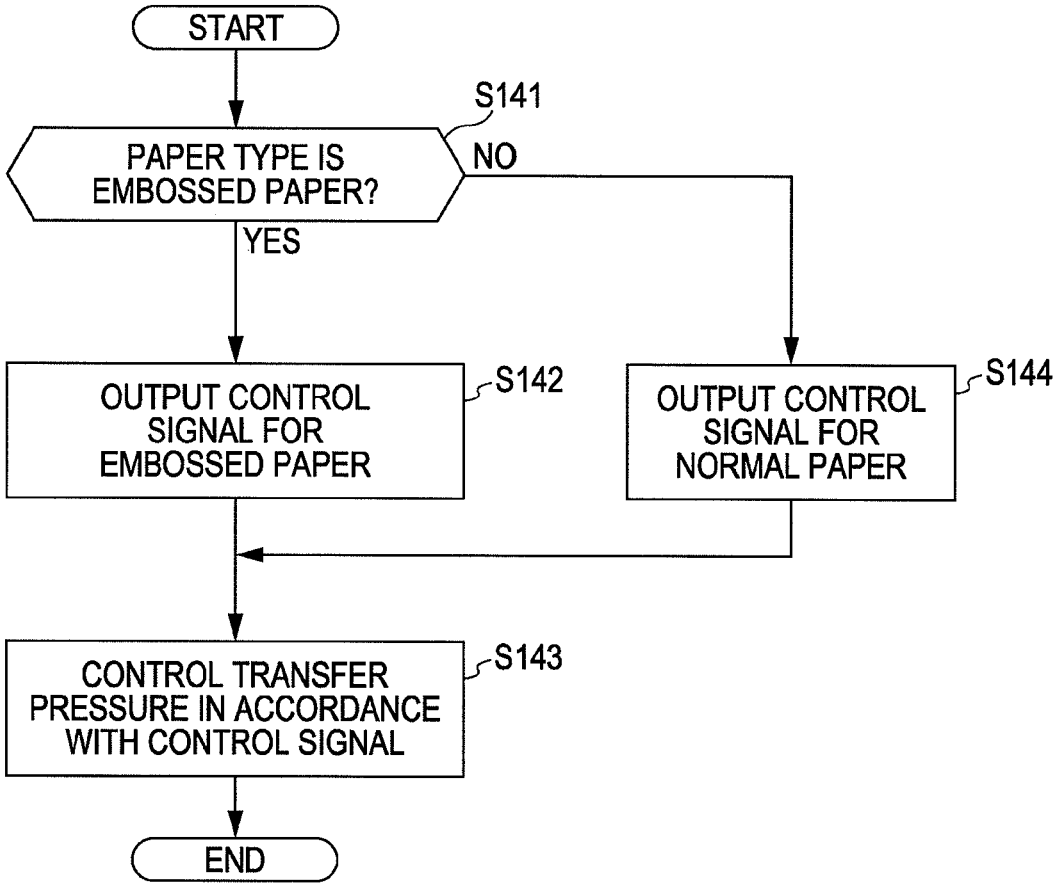
FIG. 9 illustrates an operation flow of a first transfer control process performed by the image forming apparatus according to the exemplary embodiment.

If the control unit 101 determines that the control state of the first transfer device 30 is to be changed (YES in step S130), a control signal representing the control state corresponding to the paper type determined in step S120 is transmitted to the first transfer device 30, and the first transfer control process is performed (step S140). The first transfer control process will now be described in detail with reference to the operation flow illustrated in FIG. 9.

If the paper type determined in step S120 in FIG. 8 is the embossed paper (YES in step S141), the control unit 101 transmits a control signal representing the embossed-paper receiving state to the first transfer device 30 (step S142). Then, when the first transfer device 30 receives the control signal representing the embossed-paper receiving state from the control unit 101, the first transfer device 30 drives the stepping motor 354 so as to change the state thereof from the normal-paper receiving state illustrated in FIGS. 2A and 2B to the embossed-paper receiving state illustrated in FIGS. 3A and 3B, thereby reducing the transfer pressure of the intermediate transfer belt 25 (step S143).

If the paper type determined in step S120 is the normal paper (NO in step S141), the control unit 101 transmits a control signal representing the normal-paper receiving state to the first transfer device 30 (step S144). Then, the first transfer device 30 drives the stepping motor 354 so as to change the state thereof from the embossed-paper receiving state illustrated in FIGS. 3A and 3B to the normal-paper receiving state illustrated in FIGS. 2A and 2B, thereby controlling the transfer pressure (step S143).

Referring to FIG. 8 again, after the control unit 101 has set the control state of the first transfer device 30 to the control state corresponding to the paper type of the recording sheet 60 in step S140, the control unit 101 performs the misregistration detection process for detecting the difference of the transfer position on the intermediate transfer belt 25 (step S150).

Figure 10:
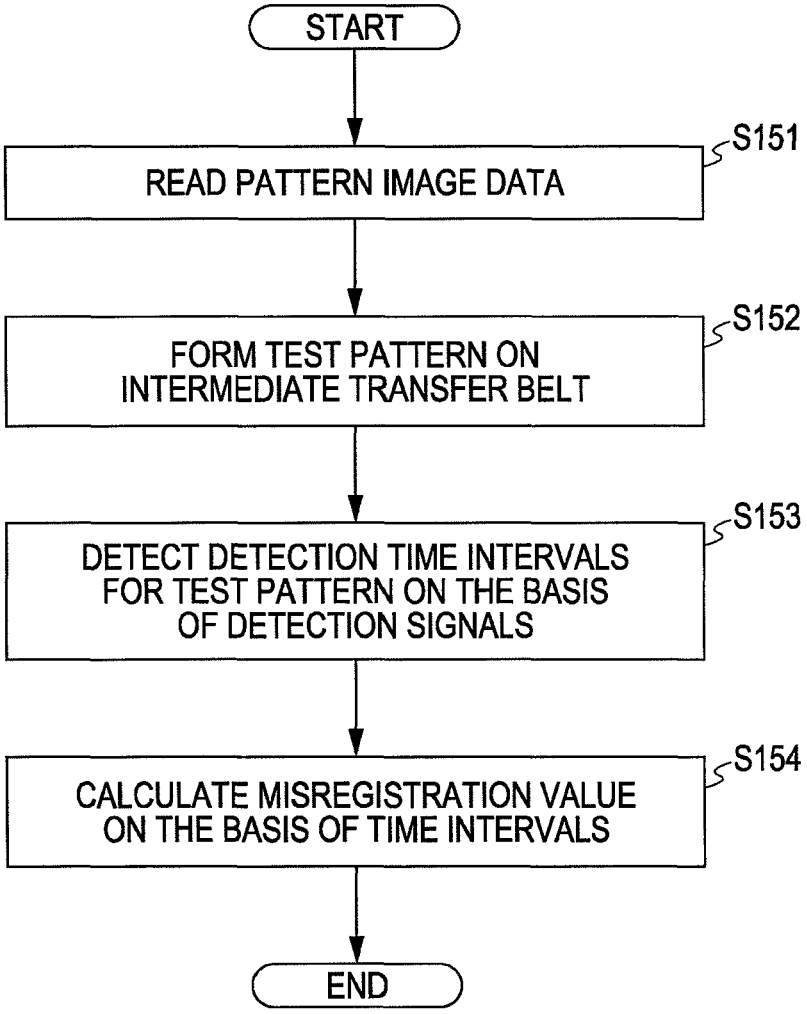
FIG. 10 illustrates an operation flow of a misregistration detection process performed by the image forming apparatus according to the exemplary embodiment.

FIG. 10 illustrates the operation flow of the misregistration detection process performed in step S150. The control unit 101 reads the pattern image data from the memory unit 102 and supplies the pattern image data to each image forming unit 13 (step S151).

The toner image of the test pattern 610 is transferred onto the intermediate transfer belt 25 by each image forming unit 13 on the basis of the pattern image data supplied from the control unit 101 (step S152). The control unit 101 causes the misregistration detection unit 105 to detect the toner image of the test pattern 610 that has been transferred onto the intermediate transfer belt 25. Then, the correction unit 103A of the image processing unit 103 detects detection time intervals for the test pattern 610 on the basis of the detection signals of the test pattern 610 output from the pattern detectors 600 included in the misregistration detection unit 105 (step S153). Then, the misregistration value of each color is determined on the basis of the detection time intervals (step S154).

Referring to FIG. 8 again, the control unit 101 causes the image processing unit 103 to subject the image data of the respective colors stored in the RAM 110C to the image processes, such as density adjustment. In addition, the control unit 101 determines the correction value for correcting the image forming position of the image data after the image processes on the basis of the misregistration value determined in step S150. The control unit 101 corrects the image data on the basis of the correction value, and supplies the corrected image data to each image forming unit 13 (step S160). An electrostatic latent image corresponding to the corrected image data of each color is formed on each photosensitive drum 15 by the corresponding image forming unit 13, and is developed. Then, the toner image formed on the photosensitive drum 15 by the developing process is transferred onto the intermediate transfer belt 25 by the corresponding first transfer device 30, which is set to the control state corresponding to the type of the recording sheet 60. Then, the toner image formed on the intermediate transfer belt 25 is transferred onto the recording sheet 60 by the second transfer roller 50, and the recording sheet 60 is ejected to the paper ejection tray 64 (step S170).

In the image forming apparatus 1 according to the above-described exemplary embodiment, the control state of each first transfer device 30 is changed in accordance with the current control state of the first transfer device 30 and the paper type of the recording sheet 60. In addition, when the control state of the first transfer device 30 is changed, the misregistration on the intermediate transfer belt 25 caused in the first transfer process is detected before the image data of the original document 2 specified by the user is transferred onto the recording sheet 60 in the second transfer process. Then, the image forming position of the image to be formed on the recording sheet 60 is corrected. Thus, the misregistration owing to the change in the transfer pressure applied by the first transfer device 30 is determined in advance, so that color registration in the image formed on the recording sheet 60 can be reduced.

Modifications

Although an exemplary embodiment of the present invention is described above, the present invention is not limited to the above-described exemplary embodiment, and the following modifications are included in the scope of the present invention.

Figure 11:
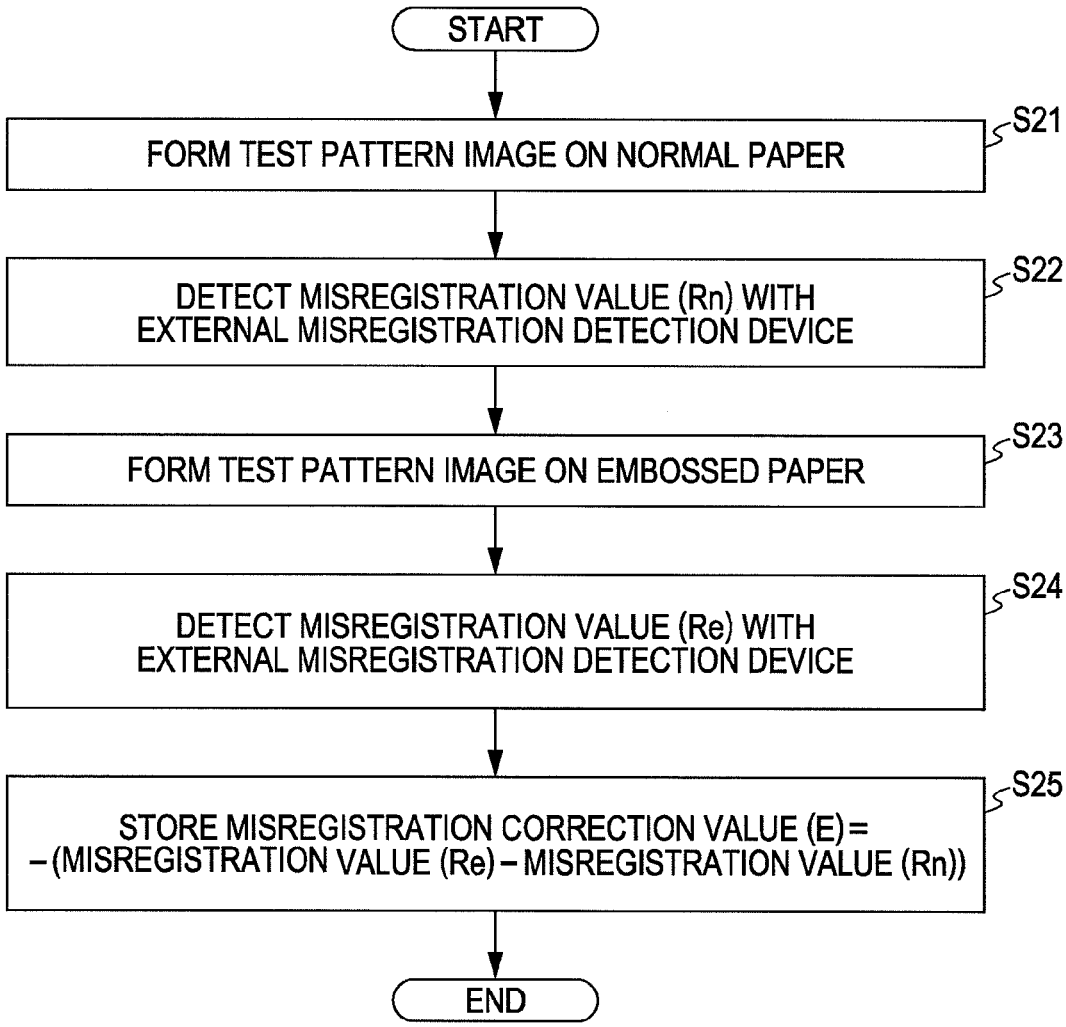
FIG. 11 illustrates an operation flow of a process for determining a misregistration correction value according to a modification.
Figure 12:
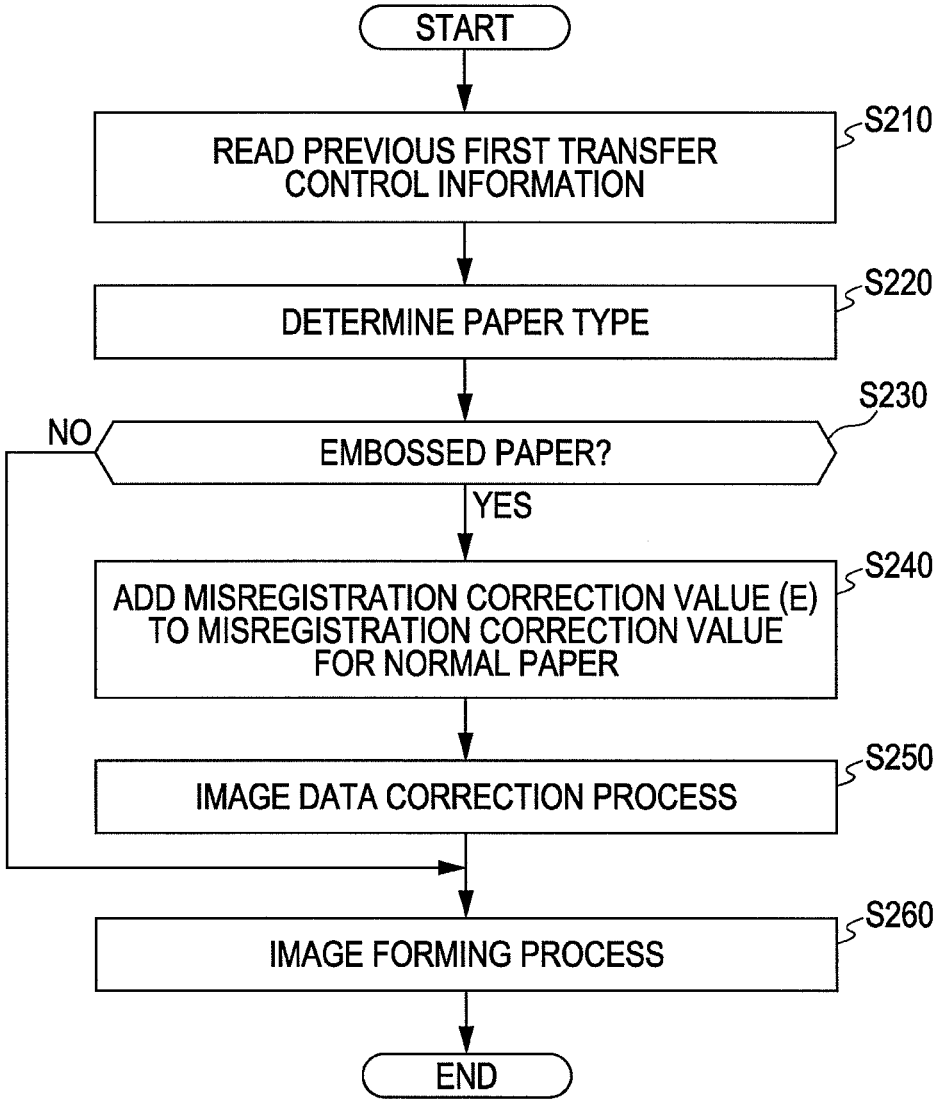
FIG. 12 illustrates an operation flow of an image forming process according to the modification.

(1) In the above-described exemplary embodiment, the misregistration detection process is performed each time the paper type is switched between the normal paper and the embossed paper. However, the correction value for correcting the misregistration caused when the paper type is switched from the normal paper to the embossed paper can be stored in advance and used to perform the correction of the image forming positions for the image data. In this case, the correction value used when the paper type is switched from the normal paper to the embossed paper are obtained by measurements and stored by the process illustrated in FIG. 11. The operation flow illustrated in FIG. 11 will now be described. First, an image of the test pattern 610 similar to that in the exemplary embodiment is formed on a sheet of normal paper (step S21). Then, the misregistration value (Rn) of the test pattern on the normal paper is detected by a misregistration detection device provided outside the image forming apparatus 1 (step S22). In addition, an image of the test pattern 610 similar to that in the exemplary embodiment is formed on a sheet of embossed paper (step S23). Then, the misregistration value (Re) of the test pattern on the embossed paper is detected by the misregistration detection device provided outside the image forming apparatus 1 (step S24). Then, the difference between the detected misregistration value (Rn) on the normal paper and the detected misregistration value (Re) on the embossed paper is stored in the memory unit 102 as a misregistration correction value (E). The correction value for when the normal paper is used is determined by detecting the misregistration in accordance with the temperature, the time, and the number of printing sheets, as in the related art. The thus-determined correction value is stored in advance in the memory unit 102 (step S25). The operation for correcting the image forming position using the misregistration correction value stored in advance will now be described with reference to FIG. 12. In the following description, it is assumed that the paper type of the recording sheet 60 that has been previously subjected to the transfer process is the normal paper. Referring to FIG. 12, first, the control unit 101 reads the previous first transfer control information that is stored in the memory unit 102 (step S210). Then, the control unit 101 determines whether the paper type specified by the user is the normal paper or the embossed paper (step S220). If the paper type specified by the user is the embossed paper (YES in step S230), the control unit 101 reads the misregistration correction value for the normal paper and the misregistration correction value (E) for when the paper type is switched to the embossed paper from the memory unit 102. Then, the control unit 101 adds the misregistration correction value for the normal paper to the misregistration correction value (E) for the embossed paper (step S240). The control unit 101 performs a process for correcting the image forming position of the image data on the basis of the sum (step S250), and forms an image on a sheet of embossed paper (step S260). If the paper type is normal paper instead of embossed paper in step S230 (NO in step S230), the image forming process is performed similarly to the previous time the image forming process has been performed (step S260). With this structure, it is not necessary to perform the misregistration detection process when the paper type is switched between the embossed paper and the normal paper. As a result, productivity of the image forming process can be increased.

In the above-described example, the misregistration correction value for when the paper type is switched between the normal paper and the embossed paper is stored in advance. However, the misregistration correction value may instead be stored in advance in association with the range of the misregistration value obtained by measurements. In such a case, the misregistration detection process is performed when the paper type of the recording sheet 60 is changed, and the misregistration correction value for the misregistration value range corresponding to the detection result is used to correct the image forming position.

(2) According to the above-described exemplary embodiment, the control state of the first transfer device 30 is changed in accordance with the paper type specified by the user through the operation unit 104. However, the recording sheet 60 may be detected by, for example, an optical sensor and the paper type of the recording sheet 60 may be determined by the control unit 101 on the basis of a signal output by the optical sensor as a result of the detection. More specifically, when the original document specified by the user is read, the amount of light incident on and reflected by the recording sheet 60 is measured by the optical sensor. It is determined that recording sheet 60 is the normal paper if the measured amount of the reflected light is larger than or equal to a threshold (the amount of reflected light corresponding to the degree of surface irregularity of the normal paper) stored in advance in the ROM 101B. It is determined that the recording sheet 60 is the embossed paper if the measured amount of the reflected light is smaller than the threshold.

(3) In addition, in the above-described exemplary embodiment, the transfer pressure applied by the first transfer device 30 is controlled in accordance with the paper type of the recording sheet 60. However, the first transfer bias applied by the first transfer bias source 320 included in the first transfer device 30 may instead be controlled in accordance with the paper type. When the transfer electric field at the transfer position of the first transfer roller 310 is reduced by controlling the first transfer bias, the electrostatic force that causes the toner to be transferred to the intermediate transfer belt 25 decreases. Therefore, the adhesion force applied to the toner on the intermediate transfer belt 25 decreases. As a result, similar to the above-described exemplary embodiment, the toner image can be reliably transferred, without leaving blank portions, onto the recording sheet 60 such as a sheet of embossed paper that has a larger degree of irregularity than that of the normal paper. In this case, the setting value of the first transfer bias is stored as the first transfer control information. The misregistration detection process similar to that in the above-described exemplary embodiment is performed when the first transfer bias is changed, and the image forming position is corrected accordingly.

(4) The programs to be executed by the CPU 101A may be provided in such a state that the programs are stored in a computer-readable recording medium, such as a magnetic recording medium, an optical recording medium, a magneto-optical recording medium, and a semiconductor memory, and be installed in each apparatus. Examples of magnetic recording media are a magnetic tape and a magnetic disc, such as a hard disk drive (HDD) and a flexible disk (FD). An example of an optical recording medium is an optical disk, such as a compact disc (CD) and a digital versatile disk (DVD). Alternatively, the programs may be downloaded and installed into each apparatus through communication lines.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a plurality of toner-image forming units that receive image data and form electrostatic latent images on image bearing members in accordance with the image data, and form toner images of respective colors by developing the electrostatic latent images;

an intermediate transfer member onto which the toner images are transferred;

a transfer unit that transfers the toner images of the respective colors onto the intermediate transfer member;

a misregistration detector that detects a difference of a transfer position of each of the toner images of the respective colors on the intermediate transfer member when a degree of surface irregularity of a recording medium is greater than or equal to a predetermined threshold, before a toner image, that is to be transferred onto the recording medium, is formed, wherein the controller controls such that when the degree of surface irregularity of the recording medium is greater than or equal to the threshold, the at least one of the transfer pressure and the transfer electric field is smaller than that used when the degree of surface irregularity is smaller than the threshold.

2. The image forming apparatus according to claim 1, further comprising:

a type-receiving unit that receives a specified type of the recording medium, wherein the controller changes the at least one of the transfer pressure and the transfer electric field in accordance with the specified type of the recording medium received by the type-receiving unit.

3. An image forming apparatus, comprising:

a plurality of toner-image forming units that receive image data and form electrostatic latent images on image bearing members in accordance with the image data, and form toner images of respective colors by developing the electrostatic latent images;

an intermediate transfer member onto which the toner images are transferred;

a determining unit that determines a type of a recording medium;

a transfer unit that transfers the toner images of the respective colors formed by the toner-image forming units onto the intermediate transfer member;

a misregistration detector that detects a difference of a transfer position of each of the toner images of the respective colors on the intermediate transfer member when a degree of surface irregularity of a recording medium is greater than or equal to a predetermined threshold, before a toner image, that is to be transferred onto the recording medium, is formed;

a correction-value storage unit that stores a misregistration correction value in advance, the misregistration correction value being set in advance according to a registation process, and being used to correct the difference of the transfer position caused by the transfer control; and a correcting unit that corrects image data representing an image to be formed on the recording medium and supplies the corrected image data to the toner-image forming units, the correcting unit correcting the image data on the basis of a result of the detection performed by the misregistration detector and the misregistration correction value stored in the correction-value storage unit.

4. An image forming method, comprising:

receiving image data and forming electrostatic latent images on image bearing members in accordance with the image data;

forming toner images of respective colors by developing electrostatic latent images;

transferring the toner images of the respective colors onto an intermediate transfer member; and detecting a difference of a transfer position of each of the toner images of the respective colors on the intermediate transfer member when a degree of surface irregularity of a recording medium is greater than or equal to a predetermined threshold, before a toner image, that is to be transferred onto the recording medium, is formed, wherein when the degree of surface irregularity of the recording medium is greater than or equal to the threshold, the transfer pressure is changed to be smaller than that used when the degree of surface irregularity is smaller than the threshold.

5. The image forming apparatus according to claim 1 further comprising:

a controller that performs transfer control that changes a transfer pressure between the image bearing unit and the intermediate transfer member when the transfer unit transfers the toner images onto the intermediate transfer member.

6. The image forming apparatus according to claim 5, wherein the controller changes at least one of the transfer pressure and a transfer electric field in accordance with a degree of surface irregularity of a recording medium onto which the toner images formed on the intermediate transfer member are to be transferred.

7. The image forming apparatus according to claim 5, wherein the controller controls such that when a degree of surface irregularity of the recording medium is greater than or equal to the threshold, the at least one of the transfer pressure and the transfer electric field is smaller than that used when the degree of surface irregularity is smaller than the threshold.

8. The image forming appratus according to claim 3, wherein the transfer unit performs transfer control for changing, in accordance with the type of the recording medium determined by the determining unit, at least one of a transfer pressure and a transfer electric field applied when the toner images of the respective colors are transferred onto the intermediate transfer member.

9. The image forming method according to claim 4, further comprising performing transfer control for changing a transfer pressure applied when the toner images are transferred onto the intermediate transfer member.

10. The image forming method according to claim 9, wherein the transfer pressure is changed in accordance with a type of a recording medium onto which the toner images formed on the intermediate transfer member are to be transferred, and wherein the type of the recording medium is determined on the basis of whether or not the degree of surface irregularity of the recording medium is greater than or equal to a predetermined threshold.

* * * * *